United States Patent [19]

Bartlett

[11] 4,147,511

[45] Apr. 3, 1979

[54] PROCESS FOR SOLVENT-DRYING LEATHER

[75] Inventor: Philip L. Bartlett, Wilmington, Del.

[73] Assignee: E. I. Du Pont de Nemours and Company, Wilmington, Del.

[21] Appl. No.: 873,660

[22] Filed: Jan. 30, 1978

[51] Int. Cl.[2] ..... C14C 1/00; F26B 3/00

[52] U.S. Cl. ..... 8/94.18; 8/94.1 D; 34/9

[58] Field of Search ..... 8/94.18, 94.1 D; 34/9

[56] References Cited

U.S. PATENT DOCUMENTS

| | | | |
|---|---|---|---|
| 2,781,241 | 2/1957 | Ushakoff | 8/94.18 |
| 3,048,929 | 8/1962 | Kremen et al. | 34/9 |
| 3,444,625 | 5/1969 | Giella et al. | 34/9 |
| 3,559,297 | 2/1971 | Figiel | 34/9 |
| 4,039,281 | 8/1977 | Graf | 8/94.14 |

FOREIGN PATENT DOCUMENTS

| | | |
|---|---|---|
| 253290 | 2/1970 | U.S.S.R. |
| 488048 | 1/1976 | U.S.S.R. |

*Primary Examiner*—A. Lionel Clingman
*Attorney, Agent, or Firm*—James A. Costello

[57] ABSTRACT

A process for drying water-wet animal hides comprising contacting the water-wet hides with a single phase drying medium comprising a chlorine-containing carrier liquid plus methanol and removing the hides from contact with the drying medium when the requisite amount of water has been removed from the hides. The useful carrier liquids are 1,1,2-trichlorotrifluoroethane, trichlorofluoromethane, tetrachloroethylene and 1,1,1-trichloroethane.

20 Claims, No Drawings

PROCESS FOR SOLVENT-DRYING LEATHER

BACKGROUND OF THE INVENTION

This invention concerns a process for drying tanned and untanned animal hides employing single phase drying media selected from certain chlorine-containing compounds and methanol.

The manufacture of leather is primarily a water-based process that has changed relatively little over the years. A typical sequence of leather manufacturing steps is as follows, it being understood that the sequence can be varied somewhat if desired. The drying process of this invention is especially useful in steps (a) and (h) or at any desired step thereafter: (a) hides (this term as employed herein includes hides, skins and pelts) are cured after being removed from the animals to retard spoilage while they await inception of the primary leather making process; one method of curing is by drying to a moisture level of about 20% or less and adding anit-bacterial agents if desired; (b) the hides are trimmed and sorted and are usually cut lengthwise along the backbone head to tail to make two sides; (c) they are then soaked to restore lost moisture and subsequently washed to remove excess salt, dirt and blood; (d) they are then rid of excess flesh, fat and muscle; (e) treated to remove hair, epidermis and certain soluble proteins; (f) residual unhairing chemicals and nonleather-making substances are removed; (g) the hides are then pickled in an acid environment if they are to be chrome tanned; (h) they are then tanned in a process whereby they are converted into stable nonputrescible leather; tanning may be accomplished by several methods, the most important of which is by chrome tanning; (i) the hides are then wrung by machine to remove excess moisture; (j) split and shaved to adjust the thickness to that required for the end use; (k) the hides may be retanned to impart the desired properties of other tanning agents; (l) dyed; (m) subjected to a fatliquoring process whereby they are lubricated so that they will remain pliable after being dried; (n) they are then smoothed and excess moisture is removed to prepare them for drying; (o) they are dried; (p) reconditioned, if necessary, in a step whereby small amounts of moisture are added; (when hides are dried according to the process of this invention this conditioning step is not necessary since the hides can be uniformly dried to predetermined levels); (q) the hides are then mechanically flexed (staked) to improve pliability; hides are usually staked at about 20 to 35 weight percent of water; (r) buffed by sanding; (s) finished by application of film-forming materials to provide abrasion and stain resistance and color enhancement; and (t) smoothed in a plating step whereby they are subjected to steam and high pressure.

Organic solvent systems are known for drying solid surfaces. It has been found, however, that the drying of animal hides is not analogous to drying solid surfaces in that the results of treating animal hides with drying systems useful for drying solid surfaces are wholly unpredictable.

Organic drying systems have heretofore been suggested for use in processing leather. Such systems, however, do not include the carrier/methanol media described herein. Organic drying media which have been suggested heretofore include primarily acetone or methanol, or two-component media such as trichlorotrifluoroethane or tetrachloroethylene and ethanol. The carrier/methanol-based process of this invention is more efficient than ethanol containing two-component systems in terms of the rapid separation of the used drying medium into a methanol/water layer and a carrier layer and in terms of the relative noncontamination of the carrier layer.

SUMMARY OF THE INVENTION

This invention concerns an ambient temperature process for drying water-wet animal hides comprising contacting the water-wet hides with a single phase drying medium comprising a chlorine-containing carrier liquid and methanol and removing the hides from contact with the drying medium when the required amount of water has been removed.

It is pointed out that the term "hides" employed herein includes tanned and untanned hides, skins and pelts. Thus, the term "hides" encompasses "leather". Wet hides contain chemically bound and physically bound (free) water. The bulk of the free water can usually be removed by wringing. Bound water, however, is much more difficult to remove. The process of this invention is useful to remove free and chemically bound water. Furthermore, the process is applicable regardless of variation in thickness or porosity of the hides, it being understood that thicker and/or less porous hides may take somewhat longer to dry than thinner and/or more porous hides.

Chlorine-containing carrier liquids useful in the practice of this invention are 1,1,2-trichlorotrifluoroethane, trichlorofluoromethane, tetrachloroethylene, 1,1,1-trichloroethane (hereafter called methyl chloroform) and mixtures thereof. Trichlorotrifluoroethane is the preferred carrier.

Concentrations of the drying medium constituents will preferably be about 4% to 40% methanol and 60% to 96% carrier liquid. It will be appreciated, however, that concentrations of methanol below about 4% will be useful with an attendant decrease in drying efficiency in that it will take a larger volume of drying medium to remove a given quantity of water. Higher concentrations of methanol than about 40% will likewise be useful but with an attendant loss in efficiency because of the need to distill the methanol from larger amounts of methanol/water solution.

The process of this invention is especially adaptable to drying hides to predetermined water levels. Tables 1 to 7, infra, demonstrate the ability of various carrier liquid/methanol concentrations to dry hides. By adjusting the ratio of carrier liquid to methanol and the ratio of methanol to the amount of water to be removed one can process hides to almost any degree of wetness which is desired. In this regard, it is noted that successive drying stages are included within the scope of this invention.

When employing successive drying stages, the hides can be soaked, tumbled or otherwise maintained in the environment of the drying medium. After treatment in the environment of one drying medium, the hides can be contacted with fresh drying media in successive stages. The fresh media can have different constituents and/or different concentrations of carrier and methanol than did the initial contacting medium. The successive stages contemplated to be used herein include adding additional carrier and/or methanol to the hides which are in contact with the drying medium.

DETAILS OF THE INVENTION

Another facet of the process of this invention is that the water from the water-wet hides, when contacted with the drying medium, will be displaced by the methanol of the carrier/methanol drying medium. Methanol/water will then form a separate layer which is immiscible with the carrier liquid. The methanol/water layer can then be recovered from the two layer system; the methanol can be separated from the water by distillation and recombined with the carrier liquid to form a fresh supply of drying medium.

The process of this invention is characterized by the rapid separation of a predominantly methanol/water liquid layer from a predominantly carrier liquid layer upon contacting the water-wet hides with the drying medium. Layer separation usually occurs within about ten minutes of first contact and most often within three minutes of such contact. Very often separation takes place within seconds. By a predominantly methanol/-water layer is meant a layer containing less than fifty percent carrier and preferably less than twenty percent carrier.

Rapid separation allows great latitude in the design of high speed equipment for separating said layer from the carrier layer, recovering the methanol from said layer for recombination with the carrier, and subsequent relatively undelayed reuse of the carrier/methanol drying medium. The process of this invention is amenable to automation and faster throughput than heretofore possible. Furthermore, the process of this invention is compatible with most solvent-based systems for treating hides.

The solvent drying process described herein eliminates the need for oven drying to remove water with its attendant problems. For example, such oven drying may lead to stiff leather having desirable hard spots. Drying solely with methanol may also produce hard spots on leather. The process of this invention produces a softer dried hide of uniform quality. Treating agents can be added to further enhance the softness of tanned leather if desired.

Energy savings are realized by operating the process of this invention since there is no need to generate the massive amount of heat heretofore necessary to remove water from wet hides. It has been found that hides dried by the process of this invention can be heated, if desired, to remove residual solvent, without adversely affecting their properties.

As will be obvious from a study of Tables 1 to 4 hereafter, there is no need for massive clean up of the carrier fluid after separation of the used drying medium into two layers. However, a small amount of the fluid can be continually distilled to equilibrate contamination and suspended solids, if any, can easily be filtered. There will be no water or almost no water in the carrier layer. There may be some methanol remaining in said carrier layer but the methanol will obviously cause no problem because said layer will eventually be combined with fresh methanol to make up a new supply of drying medium. In any event, the carrier layer will contain at least about 90 weight percent of carrier and preferably at least about 97 weight percent of carrier.

For best results, the amount of drying medium used can be based on the amount of water to be removed from the hides and the concentration of methanol in the drying medium. Generally, it has been found economical to use about three kilograms of methanol to remove one kilogram of water. In this regard it is pointed out that use of excessive amounts of methanol, in addition to raising the problem of having to separate said methanol from the water, will lead to more carrier in the methanol/water layer after drying. Since nearly all of the carrier will accompany the methanol in the distillation process, the presence of carrier in the methanol/water layer is not a problem. In any event, it is preferred that there be less than about 20% of carrier in the methanol/water layer.

Multi-stage drying is especially useful when high loadings of wet hides would otherwise demand inordinately large-scale equipment for one-stage drying. Conventional equipment can be used with high throughputs when the equipment is arranged to treat hides serially in stages. Each successive stage or cycle will remove an additional amount of water from the hides until the desired level of water is attained.

Carrier and solvent remaining in the hides after drying can be recovered in two steps, optionally by distillation from the container in which drying contact was made followed by purging with a gas such as air or nitrogen which is then conducted to a carbon absorber operated in the art manner to trap the carrier and solvent which was in the gas. Alternatively, vacuum pumping followed by condensation downstream from the pump can be employed in place of gas purging. The preferred process employs superheated carrier to vaporize the carrier and solvent, followed by gas purging with carbon absorption as described.

EXAMPLES

Test Procedure for Evaluating Hide-Drying Media

In the drying tests summarized in Tables 1 to 4 hereafter, the following procedure was used.

A weighed piece of wet chrome tanned leather, approximately 10 cm × 10 cm square and 1 millimeter thick (split and shaved) which contained about 60 weight percent of water, was placed in a wide mouth bottle, drying fluid was added and the bottle was securely capped. The bottle was hand shaken through an arc of about 180° at the rate of about 30 to 35 cycles per minute, until phase separation (formation of two distinct phases) occurred or until 30 minutes elapsed. The phase separation time was recorded as the exact number of minutes or as >30 minutes if separation did not occur in 30 minutes. The bottle was allowed to sit undisturbed for 24 hours for equilibration and then reexamined for phase separation. At that point, if previously unobserved phase separation had occurred, the phase separation time was recorded as >30 minutes <24 hours. If no separation had occurred in 24 hours, it was assumed that separation would not occur.

Next, the piece of solvent-dried leather was transferred to a second wide mouth bottle which contained 300 ml of dry methanol. After 12 to 16 hours, the methanol solution was analyzed by Karl Fischer titration. The weight percent of water in the leather after processing was determined by dividing the amount of water found by the Karl Fischer titration by the sum of the amount of water found by said titration and the weight of dry leather.

Finally, the used drying fluid was transferred to a 250 ml separating funnel and the two layers were separated, volumes and weights recorded, and each layer was analyzed by gas chromatography for carrier, methanol, and water.

TABLE 1

TRICHLOROTRIFUORETHANE/METHANOL DRYING MEDIUM

| Wt. % of Methanol in Drying Medium | Separation Time in Sec. (S) Min. (M) Hrs. (H) | Wt. % of $H_2O$ After Processing[1] | Analysis of Used Drying Medium[2] Water/Methanol (Top) Layer Carrier Wt. % | Water/Methanol (Top) Layer $H_2O$ Wt. % | Carrier Layer Methanol Wt. % | Carrier Layer $H_2O$ Wt. % |
|---|---|---|---|---|---|---|
| 150 ml Drying Medium | | | | | | |
| 4.0 | 30 S | 49.3 | 0.3 | 50.0 | 0.1 | 0.0 |
| 75 ml Drying Medium | | | | | | |
| 2.0 | — | 56.2 | Layer Too Small To Analyze | | 0.0 | 0.0 |
| 4.0 | 30 S | 56.4 | — | — | 0.1 | 0.0 |
| 6.3 | 10 S | 54.6 | 0.22 | 10.0 | 0.1 | 0.0 |
| 15.0 | 10 S | 42.1 | 4.0 | 31.0 | 0.5 | 0.0 |
| 35.0 | 30 S | 28.8 | 14.7 | 19.6 | 1.3 | 0.0 |
| 40.0 | 2.5 M | 28.0 | 19.4 | 15.2 | 1.6 | 0.0 |
| 25 ml Drying Medium | | | | | | |
| 4.0 | — | 54.4 | Layer Too Small To Analyze | | 0.0 | 0.0 |
| 40.0 | 15 S | 44.0 | 3.6 | 51.3 | 0.3 | 0.0 |

[1]After One Stage
[2]The balance is approximately all methanol in the top layer and all carrier fluid in the carrier layer

TABLE 2

TRICHLOROTRIFUORETHANE/METHANOL CARRIER MEDIUM

| Wt. % of Methanol in 75 ml Drying Medium | Separation Time in Sec. (S) Min. (M) Hrs. (H) | Wt. % of $H_2O$ After Processing[1] | Analysis of Used Drying Medium[2] Water/Methanol (Top) Layer Carrier Wt. % | Water/Methanol (Top) Layer $H_2O$ Wt. % | Carrier Layer Methanol Wt. % | Carrier Layer $H_2O$ Wt. % |
|---|---|---|---|---|---|---|
| 4.0 | 20 M | 52.6 | 0.0 | 59.7 | 0.2 | 0.0 |
| 15.0 | 10 S | 45.0 | 7.4 | 31.8 | 0.7 | 0.0 |
| 40.0 | 9 M | 21.3 | 42.7 | 6.9 | 3.3 | 0.2 |

[1]After One Stage
[2]The balance is approximately all methanol in the top layer and all carrier fluid in the carrier layer

TABLE 3

TETRACHLOROETHYLENE/METHANOL CARRIER MEDIUM

| Wt. % of Methanol in 75 ml Drying Medium | Separation Time in Sec. (S) Min. (M) Hrs. (H) | Wt. % of $H_2O$ After Processing[1] | Analysis of Used Drying Medium[2] Water/Methanol (Top) Layer Carrier Wt. % | Water/Methanol (Top) Layer $H_2O$ Wt. % | Carrier Layer Methanol Wt. % | Carrier Layer $H_2O$ Wt. % |
|---|---|---|---|---|---|---|
| 4.0 | 6 M | 53.3 | Layer Too Small To Analyze | | 0.1 | 0.2 |
| 15.0 | 10 S | 45.4 | 0.0 | 34.1 | 0.2 | 0.0 |
| 40.0 | 10 S | 23.9 | 0.0 | 23.6 | 0.5 | 0.0 |

[1]After One Stage
[2]The balance is approximately all methanol in the top layer and all carrier fluid in the carrier layer

TABLE 4

TRICHLOROTRIFLUORETHANE/METHANOL CARRIER MEDIUM

| Wt. % of Methanol in 75 ml Drying Medium | Separation Time in Sec. (S) Min. (M) Hrs. (H) | Wt. % of $H_2O$ After Processing[1] | Analysis of Used Drying Medium[2] Water/Methanol (Top) Layer Carrier Wt. % | Water/Methanol (Top) Layer $H_2O$ Wt. % | Carrier Layer Methanol Wt. % | Carrier Layer $H_2O$ Wt. % |
|---|---|---|---|---|---|---|
| 4.0 | >24 H | 50.7 | No separation | | 0.3 | 0.1 |
| 15.0 | 1 M | 36.9 | 0.0 | 33.6 | 1.6 | 0.1 |
| 40.0 | 8 M | 18.7 | 0.0 | 14.0 | 7.1 | 0.6 |

[1]After one stage
[2]The balance is approximately all methanol in the top layer and all carrier fluid in the carrier layer Tables 5 and 6 contain summary results on raw (untanned) hides dried according to the process of this invention. The weight percent of water before drying and the weight percent after drying were determined substantially in accordance with the procedure described in connection with Tables 1 to 4.

TABLE 5

RAW COWHIDE DRIED WITH TRICHLOROTRIFLUOROETHANE (65 Wt. %) AND METHANOL (35 Wt. %) DRYING MEDIUM

| Wt. Wet Hide (g)/ Wt. % Water | | Drying Procedure in Drying Medium | Wt. % Water After Drying |
|---|---|---|---|
| 49/67.0 | | 60 hour soak in 275 ml | 42.6 |
| 42/69.7 | Stage 1: | 1 hour soak in 150 ml | 10.7 |
| | Stage 2: | 1 hour soak in 130 ml | |
| | Stage 3: | 1 hour soak in 130 ml | |
| 655/68.9 | Stage 1: | 1 hour tumble in 1200 ml | 34.8 |
| | Stage 2: | 1 hour tumble in 1000 ml | |
| | Stage 3: | 1 hour tumble in 1000 ml | |
| | Stage 4: | 3 hour tumble in 1000 ml | |
| | Stage 5: | 16 hour soak in 1000 ml | |
| 45/67.3 | Stage 1: | 1 hour soak in 150 ml | 9.9 |
| | Stage 2: | 1 hour soak in 130 ml | |
| | Stage 3: | 16 hour soak in 130 ml | |

TABLE 6

RAW PIGSKIN DRIED WITH TRICHLOROTRIFLUOROETHANE (65 Wt. %) AND METHANOL (35 Wt. %) DRYING MEDIUM

| Wt. Wet Hide(g)/ Wt. % Water | | Drying Procedure in Drying Medium | Wt. % Water After Drying |
|---|---|---|---|
| 46/76.7 | Stage 1: | 1 hour soak in 150 ml | 12.6 |
| | Stage 2: | 1 hour soak in 130 ml | |
| | Stage 3: | 16 hour soak in 130 ml | |

The data of Tables 5 and 6 are not intended to show the precise amount of water removed by drying. They do, however, show the flexibility of the process to achieve desired water levels.

Table 7 summarizes data obtained on retanned hides. The general procedure employed to dry the hides was the same as that described above in connection with Tables 1 to 6. Samples of wet vegetable retanned chrome tanned leather and "Tanak" M-3 retanned leather were dried in 30 minute contacts with solutions of 6.3 weight percent of methanol in 1,1,2-trichlorotrifluoroethane. A sample of wet chrome retanned leather was also dried for control. The results demonstrate that drying efficiency is independent of the manner of retanning.

Vegetable retanning refers to treatment with natural tannic acid extracted from bark. "Tanak" M-3 (American Cyanamid Company) is a synthetic tanning agent consisting of low molecular weight phenols reacted with formaldehyde.

TABLE 7

| Kind of Retanning | Wet Wt. of Hide (g) | Vol. of Drying Liquid (ml) | Percent of Total Water Removed |
|---|---|---|---|
| Chrome | 20.4 | 300 | 69.2 |
| Chrome | 17.9 | 600 in 2-300 ml stages | 88.3 |
| Vegetable 21.7 | 300 | 77.8 | |
| Vegetable | 23.2 | 600 in 2-300 ml stages | 92.4 |
| "Tanak" M-3 | 13.5 | 300 | 88.2 |

The data summarized in Table 7 are not intended to indicate the precise amount of water removed nor the amount of water remaining. The data do show, however, the relative efficiency of the drying medium in the one-stage drying of hides retanned by three different procedures. The efficiency can be seen from the fact that from about 69% to about 92% of the water was removed in each instance.

The embodiments of the invention in which an exclusive property or privilege is claimed are defined as follows:

1. A process for drying water-wet animal hides which comprises contacting the water-wet hides with a single phase drying medium comprising a chlorine-containing carrier liquid and methanol and removing the hides from contact with the drying medium when the required amount of water has been removed, said carrier liquid being selected from a member of the group:
1,1,2-trichlorotrifluoroethane,
trichlorofluoromethane,
tetrachloroethylene,
1,1,1-trichloroethane, and
mixtures thereof.

2. A process according to claim 1 wherein the concentration of the methanol in the drying medium is about 4 to 40 weight percent.

3. A process according to claim 1 wherein the drying is accomplished by contacting the water-wet hides in successive stages with said drying medium.

4. A process according to claim 2 wherein the drying is accomplished by contacting the water-wet hides in successive stages with said drying medium.

5. A process according to claim 1 wherein the carrier liquid is 1,1,2-trichlorotrifluoroethane.

6. A process according to claim 1 wherein the carrier liquid is trichlorofluoromethane.

7. A process according to claim 1 wherein the carrier liquid is tetrachloroethylene.

8. A process according to claim 1 wherein the carrier liquid is 1,1,1-trichloroethane.

9. A process according to claim 2 wherein the carrier liquid is 1,1,2-trichlorotrifluoroethane.

10. A process according to claim 2 wherein the carrier liquid is trichlorofluoromethane.

11. A process according to claim 2 wherein the carrier liquid is tetrachloroethylene.

12. A process according to claim 2 wherein the carrier liquid is 1,1,1-trichloroethane.

13. A process according to claim 3 wherein the carrier liquid is 1,1,2-trichlorotrifluoroethane.

14. A process according to claim 3 wherein the carrier liquid is trichlorofluoromethane.

15. A process according to claim 3 wherein the carrier liquid is tetrachloroethylene.

16. A process according to claim 3 wherein the carrier liquid is 1,1,1-trichloroethane.

17. A process according to claim 1 comprising contacting the water-wet hides with the drying medium and forming two liquid layers, one layer being predominantly methanol and water and the other being at least about 90 weight percent carrier liquid.

18. A process according to claim 17 wherein the layer of methanol and water contains less than about 20 weight percent of carrier and the layer of carrier contains at least about 97 weight percent of carrier.

19. A process according to claim 17 comprising forming the two layers within about ten minutes after first contacting the water-wet hides with the drying medium.

20. A process according to claim 19 comprising forming the two layers within about three minutes.

* * * * *